United States Patent [19]

Sarazen, Jr. et al.

[11] Patent Number: 4,493,456

[45] Date of Patent: Jan. 15, 1985

[54] TEMPERATURE-RESPONSIVE AUTOMATIC VENTILATOR

[76] Inventors: Paul M. Sarazen, Jr., 214 Fairway Dr.; Dennis A. Beam, Westfield Rd., both of Shelby, N.C. 28150

[21] Appl. No.: 430,528

[22] Filed: Sep. 30, 1982

[51] Int. Cl.[3] ..... F24F 13/14

[52] U.S. Cl. ..... 236/49; 403/408; 411/166; 411/366

[58] Field of Search ..... 236/49; 411/366, 368, 411/387, 166, 123, 119; 403/405, 408, 71

[56] References Cited

U.S. PATENT DOCUMENTS

| | | | |
|---|---|---|---|
| 2,945,705 | 7/1960 | Murray | 411/366 X |
| 3,019,887 | 2/1962 | Lowden | 411/166 X |
| 3,256,578 | 6/1966 | Luketa | 403/405 |
| 3,305,995 | 2/1967 | Armstrong et al. | 411/368 X |
| 3,415,553 | 12/1968 | Baugh | 403/408 X |
| 3,869,219 | 3/1975 | Wilson et al. | 411/387 X |
| 3,888,064 | 6/1975 | Basile | 403/408 |
| 4,175,480 | 11/1979 | Beam, Jr. et al. | 98/37 |
| 4,304,503 | 12/1981 | Gehring et al. | 403/407 |
| 4,306,820 | 12/1981 | Nelson | 403/71 X |
| 4,328,927 | 5/1982 | McSwain | 236/49 |

FOREIGN PATENT DOCUMENTS

| | | | |
|---|---|---|---|
| 418914 | 11/1934 | United Kingdom | 411/366 |

*Primary Examiner*—William E. Tapolcai

*Attorney, Agent, or Firm*—Wellington M. Manning, Jr.; Luke J. Wilburn, Jr.

[57] ABSTRACT

An improved foundation ventilator assembly including a housing in which united shutter elements are mounted for pivotal movement between an open and closed position to control air flow through the ventilator. Preferably, a thermally responsive spring is secured to one of the shutter elements to cause pivotal movement of same with changes in ambient temperature. The housing defines openings therein for the receipt of mounting means which are utilized to secure the ventilator assembly within a foundation or other wall opening. The mounting means includes a threaded element in threaded engagement with a pressure element, such that when the threaded element is screwed into the foundation or other wall surrounding the opening, force is applied against the ventilator assembly or at least partially absorbed by the pressure plate. A removably secureable rear cover or screen may also be provided to close the rear of the ventilator assembly.

10 Claims, 7 Drawing Figures

TEMPERATURE-RESPONSIVE AUTOMATIC VENTILATOR

BACKGROUND OF THE INVENTION

The present invention relates to a ventilator structure of the type that is normally disposed in the foundation of a dwelling or other type building structure. Ventilators are normally spaced around the periphery of a building, dwelling structure, or the like so as to permit proper ventilation beneath the floor level. Such ventilators are normally provided with one or more louvers or shutters that are moveable between a closed position that generally cuts off air flow through the ventilator, desirable during the colder months, and an open position that permits good air flow from the outside underneath the structure, normally during the warmer months.

Generally speaking, such vents have included two types, namely manual vents where one or more shutters is received in an air passageway with manual means to open and close same, and automatic vents where one or more shutters is received in a passageway and connected by some means to a thermally responsive spring, such as a bimetallic spring, whereby the shutters automatically open and close, with changes in ambient temperature. The present invention is preferably of the latter type and constitutes an improvement over those known to exist. Foundation ventilators for new constructions may be installed during construction of the foundation or underpinning of the structure. Conventionally, such vents are placed within openings for same, and secured in place with mortar, pins or the like. For new construction, the openings are sized for the vent such that a proper fit is normally achieved. In an existing structure where it is desirable to replace ventilators due to age, damage, or to convert from manual to automatic, it is desirable that the unit be capable of easy installation, and that the opening in the foundation wall be substantially closed to passage of insects, leaves, etc. around the ventilator structure.

The improved ventilator assembly of the present invention is economical to manufacture, easy to install, and preferably utilizes a thermally responsive spring means for shutter movement. Though exposed to ambient temperature for spring means reaction, the present vent is otherwise protected from the elements, from possible damage due to mounting errors, and is adapted for partial disassembly for cleaning. Particularly, the present ventilator assembly is adapted for ease of installation in an existing opening of a foundation wall, and though as set forth herein, prior art is known to exist, no known prior art teaches or suggests the present invention.

SUMMARY OF THE INVENTION

It is an object of the present invention to provide an improved, ventilator assembly for convenient and efficient mounting in the foundation of a dwelling structure or the like to control the ingress of air beneath the floor level of same.

Another object of the present invention is to provide an improved automatic ventilator assembly that utilizes a thermally responsive element for automatic opening and closing of shutter elements in the vent structure, and which is easily mounted in an existing foundation without the need of prior preparation of the foundation opening.

Yet another object of the present invention is to provide an improved automatic ventilator assembly where the housing for same is molded of a synthetic polymeric material and is unitary in structure and wherein the ventilator assembly is adapted for replacement installation in an existing foundation opening.

Still further, another object of the present invention is to provide an improved automatic ventilator assembly that may be conveniently installed in existing openings in foundation walls without the need for mortar, while at the same time blocking said opening against ingress of insects, leaves and the like.

Generally speaking the present invention relates to a foundation ventilator assembly comprising a housing, said housing defining an air passageway therethrough, a collar means associated with an end of said housing, and having a transversely extending section with respect to said air passageway, said collar being sized such that when associated with said housing, said transversely extending section will remain without said foundation opening, extending at least beyond said opening and being resideable against said foundation; shutter means secured within said air passageway of said housing for pivotal movement thereat, whereby when said shutter means is disposed transverse to a longitudinal axis through said passageway, said passageway is generally closed and when disposed axial with respect to said axis, said passageway is generally open; means associated with said shutter means for pivoting same about said pivotal securement to said housing, a portion of said collar means defining at least one mounting means receiving opening; and mounting means received within said at least one mounting means receiving opening, said mounting means being adapted for manual manipulation into said foundation in the absence of predrilled holes therefor to secure said foundation ventilator within said foundation opening.

More specifically, the ventilator assembly of the present invention preferably includes a moled plastic housing that is unitary in structure and has a front grid means. A collar means, which may be a separate element, or of unitary construction with the housing is provided. Behind the grid structure and within the side walls are a plurality of shutter elements that are pivotally mounted to said housing side walls and are interconnected for simultaneous movement. Walls of the housing define an air passageway therebetween through which ventilating air may pass or be excluded, depending upon the attitude of the shutter elements beyond the foundation wall in which the ventilator assembly is mounted. The shutter elements are preferably associated with a thermally responsive spring for automatic positioning responsive to ambient temperature. A separate, rear grid structure snap fits to a portion of the housing and is removeable for cleaning or maintaining the interior of the assembly. The collar means, when separate, is provided with a section that mates with a portion of said housing and extends axially thereof, and a flange section that extends transversely with respect to said housing passageway. Mounting means receiving openings are provided which mate with openings in said housing. Each such receiving opening will receive a mounting means to connect the collar and housing, and which will be screwed into the foundation adjacent said opening to fix said ventilator assembly therein.

The thermally responsive spring is preferably a coiled, bimetallic spring which may be mounted on a stationary rod with an outer free end of same secured to a portion of one of the shutter elements. Additionally, however, the thermally responsive spring may be associated with the shutter elements in any other suitable fashion, for example, as specified in U.S. Pat. Nos. 4,175,480; 4,208,010; 4,231,514; 4,243,175; and 4,328,927.

Alternatively the ventilator assembly of the present invention may include a housing that includes side walls with a unitary collar means secureable thereto. The collar portion of the unitary structure generally includes side walls axial to side walls of the housing defining an opening therewithin that corresponds in general to the size of the passageway through the housing, and further has a transversely extending peripheral flange around the side walls which is of such dimension to contact an outer surface of the foundation wall and cover any space between the vent housing and the wall, per se. The axial collar portion is provided with mounting means receiving openings, in which mounting means are received in at least certain said openings to be screwed into the foundation wall and secure the ventilator assembly in place.

Mounting means according to teachings of the present invention that may be utilized in connection with all embodiments of the present invention include a threaded element such as a set screw that may be screwed into the foundation wall without the necessity of predrilled holes. Means are received along the threaded element to engage the portion of side wall around the receiving opening, are adapted for non-rotational movement and serve as a pressure plate against the forces experienced during mounting. In a most preferred arrangement, a threaded set screw is provided having a convex forward end, and having a non-circular element threadedly received thereon with a flange-pressure plate secured thereto, the non-circular element and a portion of the flange being received in detents concentric to the receiving opening.

The removeable rear screen for the present assembly includes projecting ribs that are received within the air passageway and which are provided with interlocking means which are mateable with interlocking means associated with walls of the housing.

DESCRIPTION OF THE PREFERRED EMBODIMENTS

Figure 1:
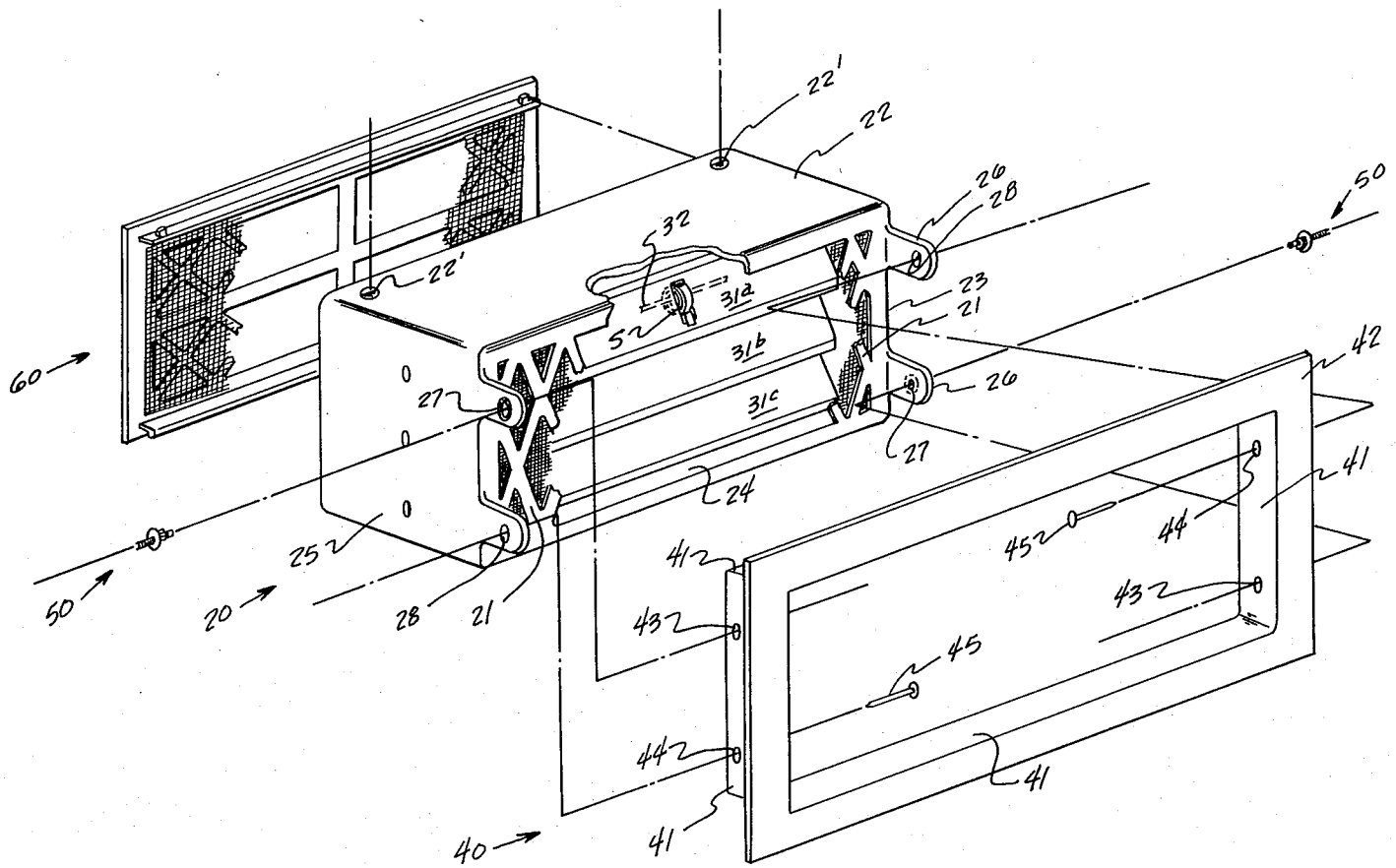
FIG. 1 is an exploded isometric view of a ventilator assembly according to teachings of the present invention.

Referring to the Figures, preferred embodiments of the present invention will now be described in detail. FIG. 1, for example, illustrates an exploded view of a ventilator assembly according to teachings of the present invention which includes a housing generally indicated as 20, a front collar generally indicated as 40 and a rear cover generally indicated as 60. In a further preferred embodiment, collar 40 is of unitary construction with housing 20 as will be hereinafter described with respect to FIG. 4.

As to the particular details of the ventilator construction of FIG. 1, housing 20 is represented by an openwork grid structure 21 which is preferably of unitary construction with side walls 22, 23, 24, 25. A screen 30 may be secured to the rear side of grid structure 21 to preclude passage of insects, debris, and the like into the interior of housing 20. Side walls 22, 23, 24 and 25 define an air passageway in which a plurality of shutter elements **31*a*, 31*b*, and 31*c* are received and mounted to side walls 23 and 25 for limited rotary movement thereat between an opened and closed position. Shutters 31*a*, 31*b* and 31*c*** are preferably united.

In a preferred embodiment, as mentioned above, a thermally responsive spring means S is utilized in conjunction with shutter elements **31*a*, 31*b*, and 31*c* to afford automatic ventilator operation. The particular arrangement between the spring means S and the shutter elements 31*a*, 31*b* and 31*c* does not form, per se, a part of the present invention may take any suitable form as exemplified in the U.S. patents mentioned hereinbefore. As exemplarily illustrated in FIG. 1, shutter element 31*a* is rotatably received on a non-rotational hex rod 32 with a thermally responsive, bimetallic spring S received around rod 32 with an outer end of same secured to shutter element 31*a*. Shutter elements 31*a*, 31*b* and 31*c*** are united by a drive rod (not shown), whereby expansion or contraction of spring S imparts simultaneous responsive movement of all of the shutter elements.

Housing 20 further has a plurality of protuberances 26 secured thereto having appropriate openings 27 therethrough. A collar generally indicated as 40 is also provided which is made up of a plurality of side walls 41 having a peripheral flange 42 secured thereto and extending outwardly therefrom. Collar 40 is thus received adjacent protuberances 26 and has appropriate openings 43 and 44 in certain of the side walls thereof that correspond to the openings 27 and 28 in protuberances 26 of housing 20. In this fashion, collar 40 may be secured to protuberances 26 to unite collar 40 and housing 20. Certain of the matching openings will receive a securement pin 45 while certain of the matching openings will receive a mounting means generally indicated as 50 that not only secures the collar to the housing, but extends into the foundation wall to secure the ventilator assembly in place, as will be defined in more detail hereinafter. In this fashion, utilizing collar 40, the ventilator assembly may be installed within existing openings of various sizes in a foundation wall, where the difference between the size of the opening and the ventilator housing will be covered by the peripheral flange 42 of collar 40. With mounting techniques as described in our prior U.S. Pat. No. 4,175,480, though the use of mortar could be omitted, it was necessary to pre-drill openings in the foundation wall to receive the mounting pins. While such does represent improvement over setting a ventilator assembly within an existing foundation opening with mortar, such technique is less desirable than that now permitted with a ventilator assembly according to teachings of the present invention.

Figure 2:
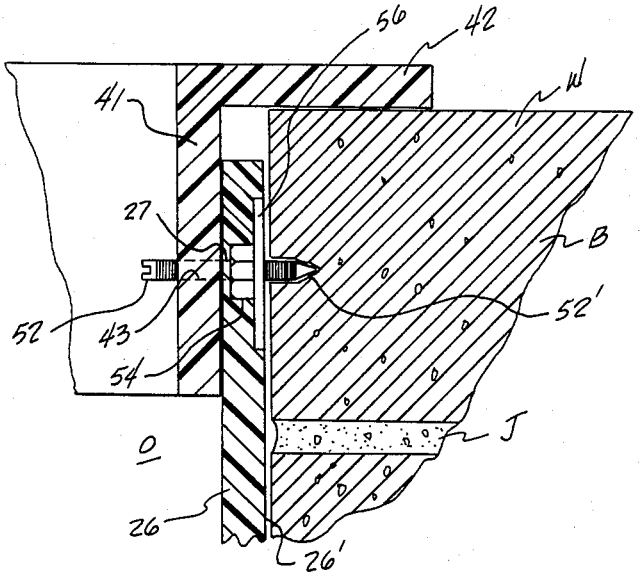
FIG. 2 is a partial horizontal cross sectional view of a vent structure according to the present invention illustrating a particular arrangement for mounting same.
Figure 5:
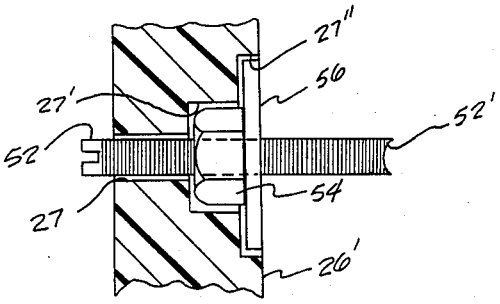
FIG. 5 is a side view of a mounting means according to teachings of the present invention with an enlarged receiving opening shown therearound.

Making particular reference to FIGS. 2, 5, and 6, mounting means according to teachings of the present invention will now be described in detail. As illustrated in part, a protuberance 26 is shown which indicates separate housing 20 and collar 40. An opening 27 is defined by protuberance 26 for receipt of mounting means 50 which is best illustrated in FIG. 5. Mounting means receiving opening 27 extends through protuberance 26 and includes a non-circular, concentric opening 27' intermediate the thickness of protuberance 26 which is in communication with an outer concentric opening 27'' on the outer side 26' of protuberance 26. With collar 40 in proper disposition with respect to housing 20 as shown in FIG. 2, side walls 41 reside within the space located between opposite protuberances 26. Mounting means 50 can then be inserted from the outer side 26' of protuberance 26, such that a set screw 52 extends inwardly through openings 27 of protuberances 26 and openings 43 of side wall 41. As illustrated in FIG. 2, mounting means 50 is shown disposed such that the ventilator assembly is properly mounted within the opening O of the foundation wall W. During insertion of mounting means 50, however, through the respective openings 27 and 43, a forward end 52' of set screw 52 would be approximately coterminous with outer surface 26' of protuberance 26, in threaded engagement with non-rotational element 54 (illustrated as a hex nut) and pressure bearing plate 56 illustrated as a flange or washer in FIGS. 5 and 6.

With the ventilator assembly so established, one installing same within opening O of foundation wall W simply engages the set screw 52 with a screw driver, allen wrench, or the like as appropriate for the particular set screw being utilized in the appropriately provided opening and turns set screw 52, to force same into the brick B or mortar joint J as the case may be with the forward tip 52' of set screw 52 embedding within the appropriate portion of the wall W. With the hex nut or other non-rotational support element 54 being secured to the pressure plate 56, the rearward force applied during installation is distributed over an adequate area of protuberance 26 to permit proper installation of the ventilator assembly without destruction of housing 20. During installation, obviously should an adequate turning force be applied to set screw 52, buckling of protuberance 26 and side wall 41 could occur. Immediately upon recognition of such a buckling action, the installation is complete and the ventilator assembly is properly installed. Note in FIG. 2, as mentioned above, that flange 42 of collar 40 extends outwardly from the ventilator assembly beyond the definition of opening O, whereby, should the opening size vary, a total closure of same is achieved, such that ingress of insects or the like around the outer dimensions of the ventilator assembly is precluded.

Figure 6:
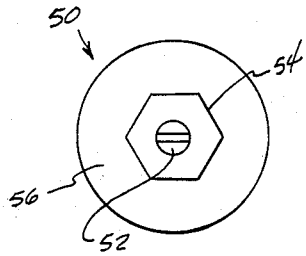
FIG. 6 is an end view of the mounting means of FIG. 5, looking from the left.

While the mounting means 50 is more specifically illustrated in FIGS. 5 and 6 as discussed above, a difference does exist from that illustrated in FIG. 2. Specifically, at the forward tip 52' of said screw 52 a concave forward end 52' is illustrated in FIG. 5, whereas a pointed forward end 52' is illustrated in FIG. 2. Such demonstrates that either would suffice, along with any other suitable tip that would properly embed within the brick B or mortar joint J in the intended fashion.

Figure 4:
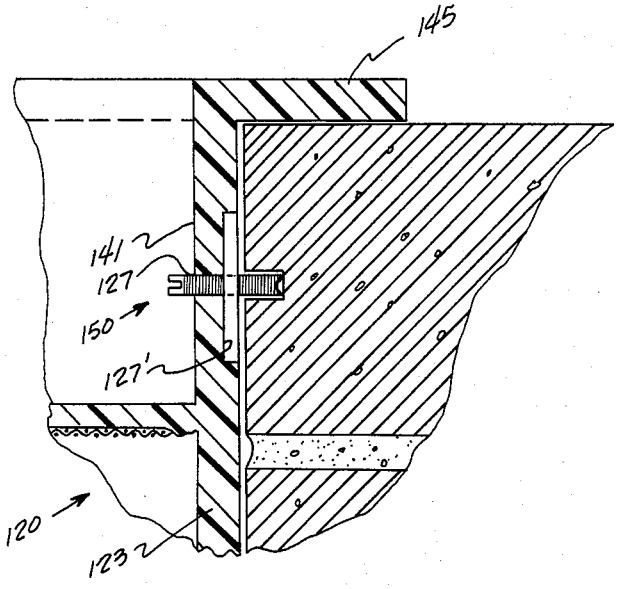
FIG. 4 is a partial horizontal cross sectional view of a vent structure according to teaching of the present invention for an embodiment utilizing a unitary structure, illustrating a mounting arrangement for same.

FIG. 4 illustrates, in part, a ventilator assembly wherein the collar and housing are of unitary structure. Note, for example, that a collar side wall 141 is of unitary construction with side wall 123 of housing 120 and extends axially outwardly therefrom to a point beyond the outer surface of wall W, where flange section 145 extends transversely with respect to collar wall 141. Additionally, opening 127 provided in collar side wall 141 received a further embodiment of the mounting means, generally 150. Mounting means 150 include only a pressure plate 156 having a threaded opening 156' therethrough. Pressure plate 156, however, is not circular as illustrated in FIG. 6, but extends along an outer edge 141' of collar wall 141, in a detent 127' beyond the next adjacent opening in collar wall 141 (such as pin receiving opening 28 in FIG. 1). At the opening presented at an opposite end of pressure plate 156, a pin such as pin 45 (FIG. 1) or a further mounting means 150 may be received therein.

Figure 7:
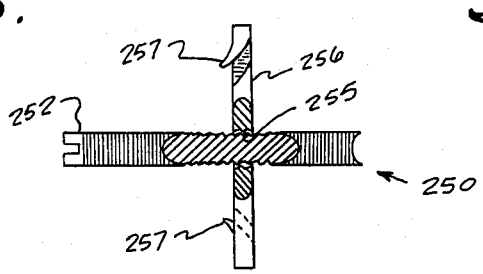
FIG. 7 is a side view of a further embodiment of a mounting means according to teachings of the present invention.

FIG. 7 illustrates yet another embodiment of the mounting means according to teachings of the present invention wherein the non-rotational feature of the mounting means is combined with the pressure plate. In FIG. 7, a set screw 252 is provided that is threadedly received through an appropriate mating opening 255 in pressure plate 256 with pressure plate 256 having barbed segments 257 on opposite sides of same. When mounting means 250 is utilized, a receiving opening in a side wall of the collar or of the unitary structure may have a uniform internal diameter as opposed to the concentric diameters as shown in FIGS. 2 and 4. Hence, with the mounting means embodiment of FIG. 7 thus placed within the receiving opening, once a turning motion is applied to set screw 252, barbs 257 of pressure plate 256 will embed in the outer surface of the side wall of the ventilator assembly to preclude against further rotation, while at the same time affording an enlarged pressure area against which the force of entry of set screw 252 is applied.

Figure 3:
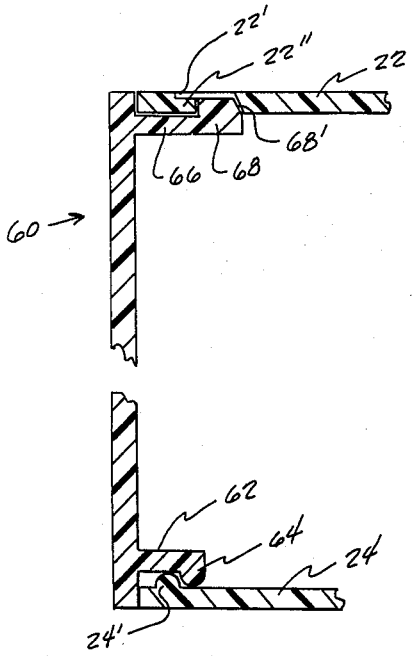
FIG. 3 is a partial vertical cross sectional view of a rear portion of a ventilator housing according to the teachings of the present invention, illustrating connection of a rear protective cover to the ventilator housing.

FIG. 3 illustrates a further aspect of the present invention directed to the rear screen generally 60. Rear screen 60 is applied to the rear of the ventilator assembly as same would reside within the foundation wall, or internally of same, and is designed to further prevent the ingress of insects, debris or the like into the ventilator assembly. Practically speaking, even with rear screen 60 in place in conjunction with forward screen 30, insects, debris and the like do somehow pass thereby and accumulate within the ventilator assembly. Thus occasional cleaning of the ventilator assembly is appropriate, whereby it is desirable that rear screen 60 be removably attachable to housing 20. As illustrated in FIGS. 1 and 3, top wall 22 of housing 20 defines a pair of openings 22' therein, adjacent the rear end of same with a portion of opening 22' being covered by a tab 22'' that is less in thickness than top wall 22. Referring specifically to FIG. 1, it is seen that openings 22' are generally circular in nature, with tab 22'' covering approximately the rear 50 percent of the opening. In like fashion, a same arrangement may be provided on bottom wall 24, or alternatively as illustrated in FIG. 3, bottom wall 24 may define an upwardly protruding rib 24' thereacross, which for the sake of illustration, is shown in FIG. 3. Back screen 60 has an inwardly protruding lip 62 that terminates as a bead 64, such that when screen 60 is brought against the rear edge of housing 20, lip 62 extends beyond bead 24' of bottom wall 24 with bead 64 residing interiorally of bead 24' of bottom wall 24 for an ultimate snap fit relationship. Along the upper surface of screen 60, a lip 66 extends inwardly therefrom having an enlarged terminal tip 68 at opposite ends of same, each having a forward beveled surface 68'. Lip 66 is sufficient in length, such that enlarged terminal tip 68 extends beyond tab 22' of top wall 22 enabling a portion of terminal tip 68 to extend upwardly into top wall opening 22'. As illustrated in FIG. 3, with such arrangement, opposite terminal tips 68 are received in openings 22' to removably lock rear screen 60 to top wall 22 with rib 62 and bead 64 locking the lower portion of screen 60 to bottom wall 24.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. An improved foundation ventilator assembly comprising:

(a) a housing, said housing including side walls, a top wall and a bottom wall defining an air passageway therethrough;

(b) a collar associated with said housing, said collar having a first axially extending section with respect to said passageway and a second transversely extending section with respect to said passageway, at least one of said housing and said collar defining mounting means receiving openings therein, said openings including concentric portions of different diameter, said larger diameter portions being outside of said small diameter portions with respect to said air passageway, (c) shutter means secured within said air passageway of said housing for pivotal movement thereabout, whereby when said shutter means are disposed transverse to a longitudinal axis through said passageway said passageway is closed and when disposed axial to said axis said passageway is open;

(d) means associated with said shutter means for pivoting same; and (e) mounting means receivable in said mounting means receiving openings and adapted for manipulation to secure a portion of same within said foundation in the absence of predrilled openings therein, said mounting means including a threaded element having a pressure plate threadably received thereabout, said pressure plate being receivable in said large diameter portions of said openings and having means associated therewith to preclude rotational movement of same, whereby said mounting means received in said openings may be rotated for movement into said foundation with pressure produced thereby being absorbed by said pressure plates and said assembly.

2. A foundation ventilator assembly as defined in claim 1 wherein said housing has a plurality of protuberances secured thereto and wherein said collar is separate from said housing, both said protuberances and said collar defining mounting means receiving openings therein, said mounting means being received in said openings to secure said collar to said housing and said assembly within said foundation opening said larger diameter portions being in said protuberances.

3. A foundation ventilator assembly as defined in claim 1 wherein said housing and said collar are of unitary structure which defines said plurality of mounting means receiving openings therein, and wherein said mounting means are received in said openings.

4. A foundation ventilator assembly as defined in claim 1 wherein said shutter means are connected and wherein said shutter pivoting means comprises a thermally responsive spring associated with one of said shutter means.

5. A foundation ventilator assembly as defined in claim 1 wherein said threaded element has a noncircular threaded element received thereon and said pressure receiving means is a flange means secured to said noncircular element.

6. A foundation ventilator assembly as defined in claim 1 wherein mounting means is a threaded element, said threaded element being in threaded engagement with said pressure receiving means and wherein said pressure receiving means has at least one protuberance thereon for nonrotational engagement with said housing.

7. A foundation ventilator assembly as defined in claim 1 wherein said housing defines two spaced apart openings along opposite sides of same; at least one of which is a mounting means receiving opening, and wherein said detent extends from one of said openings beyond the other of said openings and said pressure plate of said mounting means is received therealong.

8. A foundation ventilator assembly as defined in claim 1 comprising further a screen means adapted for attachment to a rear of said housing.

9. A foundation ventilator assembly as defined in claim 8 wherein said screen means is adapted for a removable snap fit relationship to said housing.

10. A foundation ventilator assembly as defined in claim 9 wherein said housing defines a plurality of openings therein, a portion of which is covered by tab means that are lesser in thickness than said thickness of said housing wall thereat, and wherein said screen has tip means associated therewith that mate with said openings for said removable snap fit relationship, said tip means having forward beveled edges.

* * * * *